US006674235B2

(12) United States Patent
Lim et al.

(10) Patent No.: US 6,674,235 B2
(45) Date of Patent: Jan. 6, 2004

(54) PHOTOCATHODE HAVING ULTRA-THIN PROTECTIVE LAYER

(75) Inventors: Keong-Su Lim, Daejeon (KR); Duk-Young Jeon, Daejeon (KR); Chang-Hyun Lee, Yongin (KR); Sang-Su Kim, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 72 days.

(21) Appl. No.: 10/112,888

(22) Filed: Apr. 1, 2002

(65) Prior Publication Data

US 2003/0048075 A1 Mar. 13, 2003

(30) Foreign Application Priority Data

Sep. 11, 2001 (KR) ..... 2001-55835

(51) Int. Cl.[7] ..... H01J 40/06
(52) U.S. Cl. ..... 313/542; 313/544
(58) Field of Search ..... 313/542, 523, 313/532, 541, 544

*Primary Examiner*—Vip Patel
(74) *Attorney, Agent, or Firm*—F. Chau & Associates, LLP

(57) ABSTRACT

A photocathode structure having a photoelectric face plate protective layer, in order to prevent a photoelectric effect from being deteriorated sharply due to a high reaction of oxygen with respect to most of existing photoelectric face plate materials when the photoelectric face plate used for generating photoelectrons by a photoelectric effect is exposed to the atmosphere, is provided. For example, a diamond-like carbon thin layer is used as a photocathode protective layer, to thereby perform a function of protection of the photoelectric face plate through isolation of the photoelectric face plate from the atmosphere and enable electrons generated from the photoelectric face plate to pass through a diamond-like carbon thin layer, which is deposited thinly, by the tunneling effect so that the performance of the photocathode is not affected. By using the protective layer, the processes subsequent to the photoelectric face plate deposition process can be freely performed in the atmosphere, to thereby simplify the whole process. As a result, a production cost is lowered, and manufacturing of a device or apparatus using a large-are photocathode is facilitated.

9 Claims, 3 Drawing Sheets

PHOTOCATHODE HAVING ULTRA-THIN PROTECTIVE LAYER

BACKGROUND OF THE INVENTION

1. Field of the Invention

The present invention relates to a photocathode, and more particularly, to a photocathode structure having an ultra-thin protective layer coated on the surface of a photoelectric face plate, in order to prevent performance of the photoelectric face plate from being deteriorated sharply due to oxidation in the case that the photoelectric face plate used for generating photoelectrons by a photoelectric effect is exposed to the atmosphere, and a material used for realizing the photocathode structure.

2. Description of the Related Art

A photoelectric effect is a phenomenon that electrons are externally emitted from the surface of metal when photons having an energy greater than a limited oscillation number are incident to the electrons on the metal surface. A photocathode has been being made of a material capable of emitting photoelectrons well by using the photoelectric effect. Thus, devices or apparatuses for transforming the photons incident to the photocathode into photoelectrons have been under development. The devices using the photocathode are representative of a photomultiplier tube, a photo analyzer, a gamma ray camera, a positron CT (Computer Tomography) and a flat panel display using a MCP (Microchannel plate).

In the case of devices or apparatuses using the photoelectric effect, the features of the material used for the photoelectric face plate become the most important factor which influences upon the whole characteristics of the device or apparatus. The features of the materials used for the photoelectric face plate have been enhanced greatly through the research and development up to now.

The materials used for a currently commercialized photocathode are classified into a material having alkali metal of a low work function as a main component and a material having a gallium arsenide (GaAs) semiconductor as a main component. There are Cs—I, Cs—Te, and Sb—Cs each having one kind of alkali metal, Sb—Rb—Cs, Sb—K—Cs, and Sb—Na—K each having two kinds of alkali metal, and Sb—Na—K—Cs each having three kinds of alkali metal, as the materials of the photoelectric face plate having alkali metal as a main component. There are GaAs(Cs) and InGaAs(Cs) as the materials of the photoelectric face plate having GaAs as a main component. Besides, there is Ag—O—Cs or the like. In the case that alkali metal is used for the photoelectric face plate, the photoelectric material is easily oxidized due to high reactivity of the alkali metal, to thereby lower a quantum efficiency. Thus, for this reason, the processes of fabricating or assembling the devices or apparatuses after having been fabricated the photoelectric face plate should proceed at the state where the photoelectric face plate is isolated from the atmosphere, that is, under the vacuum circumstances.

In the case that p-type doped gallium arsenide (p-GaAs) is used as a material for a photoelectric face plate, cesium (Cs) or oxygen (O) is adsorbed in the photoelectric face plate, to thereby make a photoelectric material having twice the quantum efficiency of alkali metal. However, the deposition equipment for depositing GaAs is expensive and the deposition process is complicated. Also, since GaAs is deposited using toxic gas, paying a careful attention is required during processing. Also, in order to use the deposited photoelectric material as a photocathode, impurities are removed from the surface of the photoelectric material and then the impurities removed photoelectric material should be vacuum-sealed. If the impurities removal is imperfect or the vacuum sealing is not perfectly done in the sealing process, the photoelectric material cannot be used as the photocathode. That is, the complicated process causes an actual production efficiency to decrease.

U.S. Pat. No. 5,977,705 discloses a technique of solving the problems occurring when the alkali metal or GaAs is used as the material for the photoelectric face plate, in which diamond-like carbon or diamond or the combination of both is used as the material for the photoelectric face plate. The technique of U.S. Pat. No. 5,977,705 uses cheaper deposition equipment than that used when GaAs is used as the material for the photoelectric face plate, and does not use any toxic gas. Thus, the process can be simplified and appropriate for mass-production. However, the diamond-like carbon or diamond has a negative electron affinity, and thus can be used for the photoelectric material. Nevertheless, since the quantum efficiency is smaller than the existing photoelectric material, a material such as Cs, O or H should be added, in order to exhibit an appropriate performance as a photoelectric face plate. In the case that the Cs, O or H material is added in the GaAs photoelectric material, the material having a high reactivity causes the subsequent processes to be performed in a vacuum.

FIG. 1 shows the structure of a flat panel display using a conventional photocathode. Referring to FIG. 1, the flat panel display using a conventional photocathode will be described below to review some problems in the conventional photocathode.

In the FIG. 1 flat panel display, light 4 is emitted from light emitting devices 11 which are arranged in one surface of a substrate 10 which is driven by a transmitted electrical image signal. The light 4 emitted from a light emitting devices array 12 formed of light emitting devices, for example, hydrogenated amorphous silicon-carbide (a-SiC:H) is not so sufficiently bright as to be used for image display. Amplification of the light is needed. In the case of a flat panel display using a microchannel plate (MCP) 14 to amplify the light 4, a photocathode 13 is used for transforming of the light 4 emitted from a light emitting devices array 12 into photoelectrons. The light emitted from the light emitting devices array 12 is incident to the photocathode 13 which is very near from the light emitting devices array 12. Then, photons are transformed into photoelectrons, the transformed photoelectrons are multiplied via the MCP 14. The photoelectrons multiplied by the MCP 14 are accelerated and collided with fluorescent materials which emit light of red (R), green (G) and blue (B) which are arrayed and coated regularly on one surface of a transparent substrate 16, to thereby excite the fluorescent materials respectively to emit corresponding color light.

With the above-described flat panel display, it is possible to fabricate a thin and large-area flat panel display in theory. Also, if light emitting devices for emitting infrared region light as well as light emitting devices for emitting visible light are used, a perfect color display is accomplished. However, in the case that alkali metal such as Sb, Na, Cs or the like having an emission sensitivity distribution with respect to the light of a wavelength between 400 nm and 900 nm is used as a material for a photoelectric face plate, the alkali metal having a high degree of reactivity is easily oxidized on the surface at the time of exposure to the atmosphere, to thereby reduce a quantum efficiency and lower performance of the whole flat panel display.

Also, the flat panel display using the above-described conventional photocathode raises the problem in the photocathode deposition process and the process subsequent to the photoelectric material deposition process. In the photoelectric material deposition process, a photoelectric material should be deposited on a transparent substrate in order to enable the photons emitted from a light emitting device to be incident to a photocathode. Also, a material having a high conductivity should be used as a substrate in order to apply a uniform voltage to the large-area photoelectric face plate. That is, in this case, a transparent substrate on which a transparent conductive layer is coated should be used as a substrate. The conventional transparent conductive layers are made of ZnO, $In_2O_3$, $SnO_2$ or the like. However, since such transparent conductive layers are oxides, they react with the deposited photoelectric material, to thereby raise the problem that the photoelectric material is oxidized. Since the photoelectric material has a high reactivity, the process subsequent to the photoelectric material deposition process should proceed at a vacuum state which is isolated from the atmosphere. In order to perform a chain of the subsequent processes in the vacuum, a complicated control unit is required and is very difficult to achieve the control technique. Thus, the subsequent processes in the vacuum become factors which raises a manufacturing cost of a device or apparatus. As described above, the degradation problem of the photoelectric face plate due to a high reactivity of the existing photoelectric materials should be solved.

SUMMARY OF THE INVENTION

To solve the above problems, it is an object of the present invention to provide a photocathode having an ultra-thin protective layer in which the features of EL photoelectric face plate can be maintained although the photocathode is exposed to the atmosphere, and a transparent conductive layer does not react with the photocathode although an existing transparent conductive layer is used as a cathode material.

To accomplish the above object of the present invention, there is provided a photocathode having an ultra-thin protective layer comprising: a transparent substrate; a photoelectric face plate which is deposited on the transparent substrate and transforms light incident through the transparent substrate into electrons and emits the transformed electrons; and a first photoelectric face plate protective layer which covers the surface of the photoelectric face plate and isolates the photoelectric face plate from the atmosphere.

Here, the electrons emitted from the photoelectric face plate pass through the first photoelectric face plate by the tunneling effect.

Also, in order to apply a uniform voltage to the large-area photoelectric face plate, a transparent substrate (for example, a transparent conductive plate) on which a material having a transparent and high electrical conductivity (for example, a transparent conductive material) is coated should be used as a substrate. In the case that a photoelectric material is deposited on the substrate, a second photoelectric face plate is deposited and interposed between the photoelectric face plate and the transparent conductive layer in order to prevent the problem that the transparent conductive material reacts with the photoelectric material and thus the photoelectric face plate is oxidized.

BRIEF DESCRIPTION OF THE DRAWINGS

The above object and other advantages of the present invention will become more apparent by describing the preferred embodiments thereof in more detail with reference to the accompanying drawings in which.

DETAILED DESCRIPTION OF THE INVENTION

Preferred embodiments of the present invention will be described with reference to the accompanying drawings.

Figure 2:
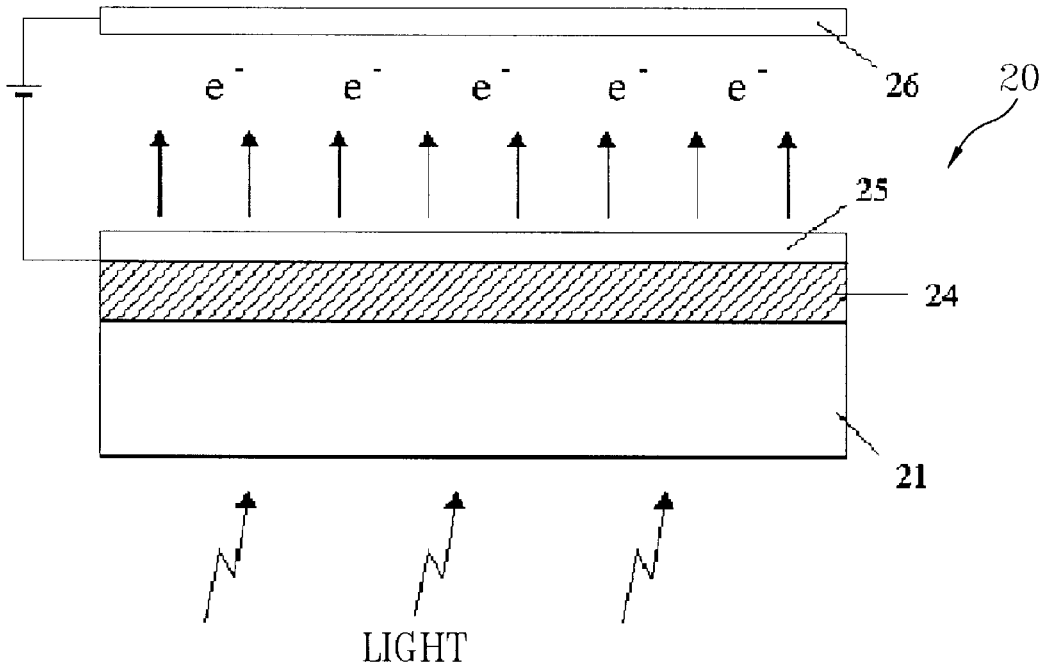
FIG. 2 is a sectional view showing a photocathode according to a first embodiment of the present invention.

Referring to FIG. 2, a transparent substrate 21 may be made of commercialized glass through which externally incident light can be well transmitted. In particular, silica, $MgF_2$ or the like having an excellent transmissivity of an ultra-violet region can be used as the transparent substrate 21. In particular, in the case that an array of light emitting devices emits the ultra-violet region light, fused quartz, synthetic quartz, sapphire, $MgF_2$ or the like having an excellent transmissivity of an ultra-violet region should be used as the transparent substrate 21.

If light is incident to the surface of a photoelectric face plate 24 through the transparent substrate 21, a photocathode 20 emits electrons from the photoelectric face plate 24 to an anode 26.

A first photoelectric face plate protective layer 25 is deposited on the photoelectric face plate 24 with a very thin thickness, for example, a thin thickness of several Å to several tens Å, in order to prevent the photoelectric face plate 24 contacting the atmosphere from making the photoelectric material oxidized. In this case, the electrons generated from the photoelectric face plate 24 are transmitted through the first photoelectric face plate protective layer 25 without any loss as little as possible. Thus, although the first photoelectric face plate protective layer is used, a photoelectric efficiency of the photocathode 20 does not change. In the first embodiment of the present invention, a tunneling effect is used as a method of transmitting the photoelectrons generated in the photoelectric face plate 24 without any loss. By use of the tunneling effect, if even a transparent and low electrical conductive material can be deposited in a vacuum, and deposited thinly so as to be regenerated, the deposited layer is used as the photoelectric face plate protective layer 25.

The first photoelectric face plate protective layer 25 should contact the photoelectric face plate 24 in order to play a role of a physical, chemical and mechanical protective layer, in addition to the above-described feature, and have a strong intensity. Also, the first photoelectric face plate protective layer 25 should have a wide optical energy band gap in order to transmit the light emitted from the light emitting device.

$SiO_2$, diamond-like carbon, $Si_3N_4$ or the like can be used as a material having the above-described feature.

In this embodiment, the case that a diamond-like carbon thin layer is; used as a material of the first photoelectric face plate protective layer 25 among the above-described materials will be described below.

First, a photoelectric material is deposited on the transparent substrate 21 to form the photoelectric face plate 24. After the photoelectric face plate 24 has been deposited through deposition of the photoelectric material, the first photoelectric face plate protective layer 25 is deposited on the photoelectric face plate 24 in the same vacuum equipment, by depositing a diamond-like carbon thin layer, for example, using a photo chemical vapor deposition (photo-CVD) method so that the photoelectric face plate can be isolated completely from the atmosphere.

The diamond-like carbon thin layer has a mechanical solidity as high as 1200 kg/mm$^2$ in hardness and a chemical stability, to thus play a role of a physical, chemical and mechanical protective layer sufficiently. Also, since the diamond-like carbon thin layer has an optical energy band gap characteristic as high as 3.5 eV or more according to a manufacturing method, a light absorption loss in the visible light region does not nearly occur. Above all, the diamond-like carbon is a material having a negative electron affinity to thereby facilitate electrons to emit in a vacuum. The photo-CVD method can be used as a method for fabricating the diamond-like carbon thin layer. In this case, the diamond-like carbon thin layer in which tunneling of several Å to several tens Å can be deposited so as to be regenerated.

Figure 3:
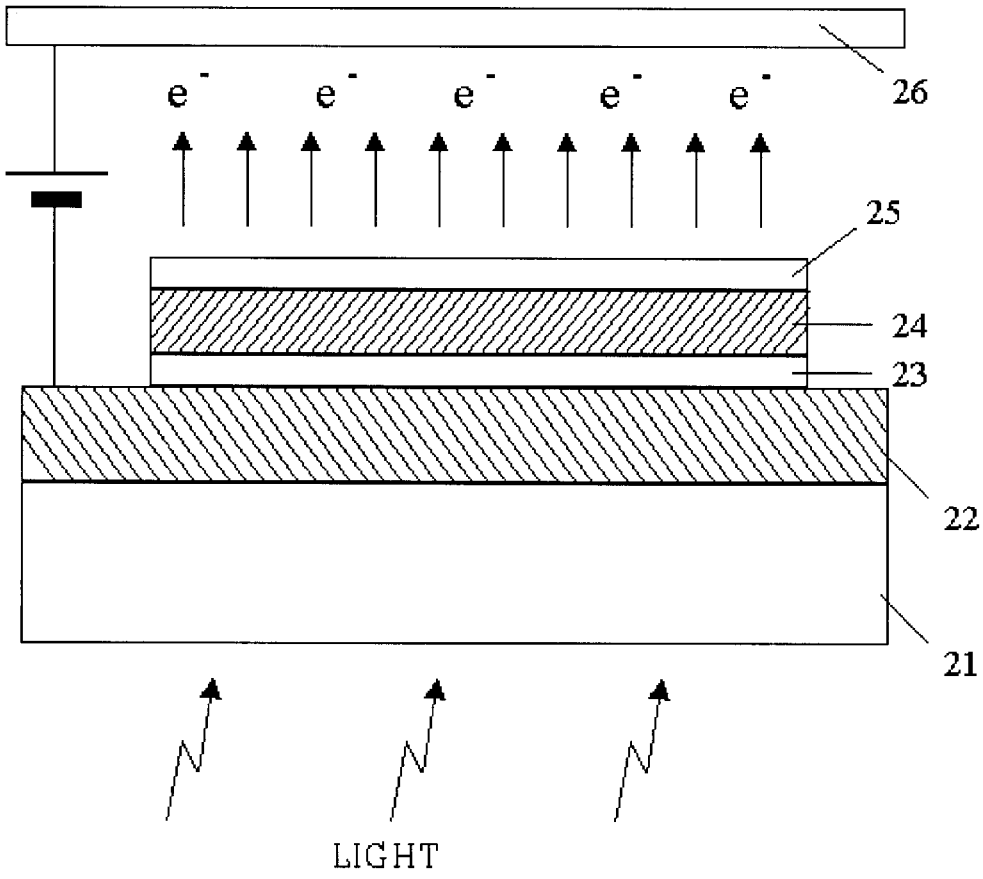
FIG. 3 is a sectional view showing a photocathode according to a second embodiment of the present invention.

FIG. 3 is a sectional view showing a photocathode according to a second embodiment of the present invention.

In the second embodiment, a transparent conductive plate 22 used as a cathode material is interposed between the transparent substrate 21 and the photoelectric face plate 24 of the first embodiment. An existing transparent conductive layer is used as the transparent conductive plate 22.

A transparent conductive layer is deposited on the transparent substrate 21 to thereby form a transparent conductive plate 22. ZnO, $In_2O_3$, $SnO_2$ or the like is used as a material of the transparent conductive plate 22. As such, in the case that the transparent conductive plate 22 deposited on the transparent substrate 21 is used, a reaction occurs between the transparent conductive plate 22 and the photoelectric face plate 24 due to direct contact of the material used as the transparent conductive plate 22 and the photoelectric face plate 24. In order to prevent such a reaction, another protective layer, that is, a second photoelectric face plate protective layer 23 is formed between the transparent conductive plate 22 and the photoelectric face plate 24. As an example, a diamond-like carbon thin layer is used as the second photoelectric face plate protective layer 23. The second photoelectric face plate protective layer 23 can be manufactured by using the same photo-CVD method as that of the first photoelectric face plate protective layer 25. Here, the optical energy band gap of the second photoelectric face plate protective layer 23, that is, the diamond-like carbon thin layer is higher than the energy of incident photons in order to remove an absorption loss of the photons incident to the photoelectric face plate 24 through the transparent substrate 21.

After the second photoelectric face plate protective layer 23 has been deposited, the photoelectric material is deposited thereon to form the photoelectric face plate 24. The photoelectric material of alkali metal group is deposited by using a thermal evaporation method.

After the photoelectric face plate 24 has been deposited, the first photoelectric face plate protective layer 25 is deposited by using a photo-CVD method in the same vacuum equipment immediately after the photoelectric material has been deposited.

As described above, the photocathode having an ultra-thin protective layer according to the present invention includes a photoelectric face plate protective layer having a thickness of several Å to several tens Å on the surface of the photoelectric face plate, to thereby prevent the performance of the photocathode from lowering, and simultaneously prevent the photoelectric face plate from being oxidized by isolating the photoelectric face plate from the atmosphere. Accordingly, the processes subsequent to the photoelectric face plate deposition process can be freely performed in the atmosphere, to thereby simplify the whole process. As a result, a production cost is lowered, and a large-are photocathode can be manufactured.

The present invention is not limited to the above-described embodiments. It is apparent to one who has an ordinary skill in the art that there may be many modifications and variations within the same technical spirit of the invention.

What is claimed is:

1. A photocathode having an ultra-thin protective layer, for transforming light into electrons by using a photoelectric effect, the photocathode comprising:

a transparent substrate;

a photoelectric face plate which is deposited on the transparent substrate and transforms light incident through the transparent substrate into electrons and emits the transformed electrons; and a first photoelectric face plate protective layer which covers the surface of the photoelectric face plate, isolates the photoelectric face plate from the atmosphere;

wherein the electrons emitted from said photoelectric face plate pass through said first photoelectric face plate by a tunneling effect.

2. The photocathode of claim 1, further comprising a transparent conductive plate between the transparent substrate and the photoelectric face plate.

3. The photocathode of claim 2, further comprising a second photoelectric face plate protective layer between the transparent conductive plate and the photoelectric face plate.

4. The photocathode of claim 1, wherein said photoelectric face plate protective layer has a thickness of several Å to several tens Å.

5. The photocathode of claim 2, wherein said photoelectric face plate protective layer has a thickness of several Å to several tens Å.

6. The photocathode of claim 3, wherein said photoelectric face plate protective layer has a thickness of several Å to several tens Å.

7. The photocathode of claim 4, wherein said photoelectric face plate protective layer is made of one selected from the group consisting of diamond-like carbon, diamond, $SiO_2$, and $Si_3N_4$.

8. The photocathode of claim 5, wherein said photoelectric face plate protective layer is made of one selected from the group consisting of diamond-like carbon, diamond, $SiO_2$, and $Si_3N_4$.

9. The photocathode of claim 6, wherein said photoelectric face plate protective layer is made of one selected from the group consisting of diamond-like carbon, diamond, $SiO_2$, and $Si_3N_4$.

* * * * *

UNITED STATES PATENT AND TRADEMARK OFFICE

CERTIFICATE OF CORRECTION

PATENT NO. : 6,674,235 B2
DATED : January 6, 2004
INVENTOR(S) : Lim et al.

Figure 1:
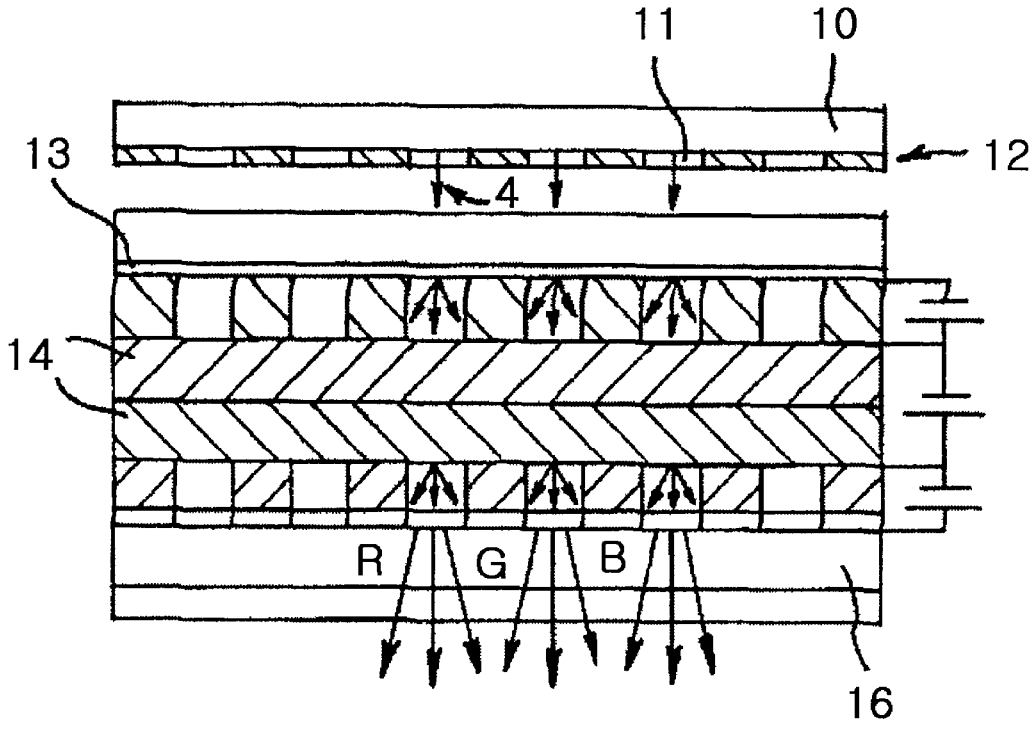
FIG. 1 shows the structure of a flat panel display using a conventional photocathode.

It is certified that error appears in the above-identified patent and that said Letters Patent is hereby corrected as shown below:

The title page consisting of the illustrated figure 1 should be deleted to appear as per attached title page.

Signed and Sealed this

Twenty-sixth Day of July, 2005

JON W. DUDAS
*Director of the United States Patent and Trademark Office*

(12) United States Patent
Lim et al.

(10) Patent No.: US 6,674,235 B2
(45) Date of Patent: Jan. 6, 2004

(54) PHOTOCATHODE HAVING ULTRA-THIN PROTECTIVE LAYER

(75) Inventors: Keong-Su Lim, Daejeon (KR); Duk-Young Jeon, Daejeon (KR); Chang-Hyun Lee, Yongin (KR); Sang-Su Kim, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 72 days.

(21) Appl. No.: 10/112,888

(22) Filed: Apr. 1, 2002

(65) Prior Publication Data

US 2003/0048075 A1 Mar. 13, 2003

(30) Foreign Application Priority Data

Sep. 11, 2001 (KR) ..... 2001-55835

(51) Int. Cl.[7] ..... H01J 40/06
(52) U.S. Cl. ..... 313/542; 313/544
(58) Field of Search ..... 313/542, 523, 313/532, 541, 544

*Primary Examiner*—Vip Patel
(74) *Attorney, Agent, or Firm*—F. Chau & Associates, LLP

(57) ABSTRACT

A photocathode structure having a photoelectric face plate protective layer, in order to prevent a photoelectric effect from being deteriorated sharply due to a high reaction of oxygen with respect to most of existing photoelectric face plate materials when the photoelectric face plate used for generating photoelectrons by a photoelectric effect is exposed to the atmosphere, is provided. For example, a diamond-like carbon thin layer is used as a photocathode protective layer, to thereby perform a function of protection of the photoelectric face plate through isolation of the photoelectric face plate from the atmosphere and enable electrons generated from the photoelectric face plate to pass through a diamond-like carbon thin layer, which is deposited thinly, by the tunneling effect so that the performance of the photocathode is not affected. By using the protective layer, the processes subsequent to the photoelectric face plate deposition process can be freely performed in the atmosphere, to thereby simplify the whole process. As a result, a production cost is lowered, and manufacturing of a device or apparatus using a large-are photocathode is facilitated.

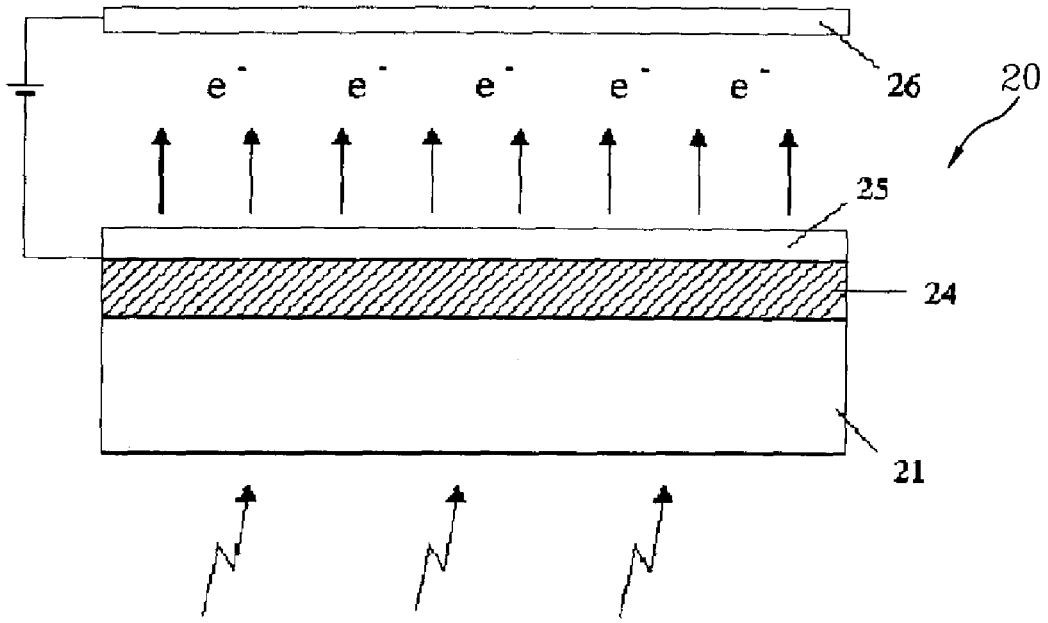

9 Claims, 3 Drawing Sheets